US008845440B2

(12) United States Patent
Haut

(10) Patent No.: US 8,845,440 B2
(45) Date of Patent: Sep. 30, 2014

(54) INFANT CARE APPARATUS

(71) Applicant: Robert E. Haut, West Chester, PA (US)

(72) Inventor: Robert E. Haut, West Chester, PA (US)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 75 days.

(21) Appl. No.: 13/742,310

(22) Filed: Jan. 15, 2013

(65) Prior Publication Data

US 2013/0184088 A1 Jul. 18, 2013

Related U.S. Application Data

(60) Provisional application No. 61/632,106, filed on Jan. 18, 2012.

(30) Foreign Application Priority Data

Jan. 11, 2013 (CN) ..... 2013 1 0011071

(51) Int. Cl.

| | |
|---|---|
| ***A63G 9/16*** | (2006.01) |
| ***A47D 9/02*** | (2006.01) |
| ***A47D 13/10*** | (2006.01) |
| *A63G 9/00* | (2006.01) |

(52) U.S. Cl.

CPC *A47D 13/10* (2013.01); *A47D 9/02* (2013.01); *A47D 13/105* (2013.01)

USPC ..... 472/119; 5/108

(58) Field of Classification Search

USPC ..... 472/118–125; 297/260.1, 260.2; 5/108, 5/109

See application file for complete search history.

(56) References Cited

U.S. PATENT DOCUMENTS

| | | | | |
|---|---|---|---|---|
| 7,824,273 | B2 * | 11/2010 | Clapper et al. | 472/95 |
| 7,883,426 | B2 * | 2/2011 | Bellows et al. | 472/119 |
| 8,187,112 | B2 * | 5/2012 | Guittar | 473/2 |
| 8,439,765 | B2 * | 5/2013 | Barron et al. | 472/118 |
| 2010/0052376 | A1 | 3/2010 | Hopke | |
| 2010/0201171 | A1 | 8/2010 | Velderman | |

FOREIGN PATENT DOCUMENTS

| | | | |
|---|---|---|---|
| WO | 2007056684 | A2 | 5/2007 |
| WO | 2007056684 | A3 | 5/2007 |

* cited by examiner

*Primary Examiner* — Kien Nguyen
(74) *Attorney, Agent, or Firm* — Winston Hsu; Scott Margo

(57) ABSTRACT

An infant care apparatus includes a base, a reciprocating vertical motion mechanism, a vertical motion driving module, a reciprocating pendulum motion mechanism, and a pendulum motion driving module. The vertical motion driving module is kinematically connected to the reciprocating vertical motion mechanism so as to vertically move the reciprocating vertical motion mechanism in reciprocating vertical motion with respect to the base. The pendulum motion driving module is kinematically connected to the reciprocating pendulum motion mechanism so as to pendulum move the reciprocating pendulum motion mechanism in reciprocating pendulum motion with respect to the reciprocating vertical motion mechanism. An interaction between a reciprocating vertical motion of the reciprocating vertical motion mechanism and a reciprocating pendulum motion of the reciprocating pendulum motion mechanism forms a specific motion path. Therefore, the infant care apparatus can offer various seat motion paths by controlling the reciprocating vertical motion mechanism and the reciprocating pendulum motion mechanism.

18 Claims, 10 Drawing Sheets

INFANT CARE APPARATUS

CROSS REFERENCE TO RELATED APPLICATIONS

This application claims the benefit of U.S. Provisional Application No. 61/632,106, which was filed on Jan. 18, 2012, and is incorporated herein by reference.

BACKGROUND OF THE INVENTION

1. Field of the Invention

The invention relates to an infant care apparatus, and especially relates to an infant care apparatus capable of offering a variety of seat motion paths.

2. Description of the Prior Art

Babies can be fussy and irritable at times. Typically, a mother will pick up and hold their baby rocking him gently in a variety of soothing back and forth motions until the baby has calmed down. But with the demands of multiple children to take care of or tasks to do, the mother may not have the time or resources to hold and rock her baby for extended periods.

Swings for babies have been used for many years to help do the job of soothing babies. Most babies find the pendulum motion of a swing to be very relaxing. But not all babies are happy with this type of motion. Some parents find that the only way to console their baby is to take him for a ride in a car or to bounce him gently. Because of this, products have been created that attempt to simulate other motions besides a swing. Although they do move in ways other than a swing motion, these machines lack the swing motion in combination with other motion patterns such as up and down, gliding side to side, circular, etc. Because the form of these devices is essentially a seat on top of a motorized base, parents may not understand how it works or what it does.

SUMMARY OF THE INVENTION

An objective of the invention is to use a reciprocating vertical motion mechanism and a reciprocating pendulum motion mechanism to produce various motion paths for a seat.

In order to achieve the above objective, as will be seen more clearly from the detailed description following below, according to one embodiment, an infant care apparatus is provided and includes a base, a reciprocating vertical motion mechanism, a vertical motion driving module, a reciprocating pendulum motion mechanism, and a pendulum motion driving module. The reciprocating vertical motion mechanism is disposed on the base to be capable of moving in reciprocating vertical motion in a vertical direction with respect to the base. The vertical motion driving module is kinematically connected to the reciprocating vertical motion mechanism so that the reciprocating vertical motion mechanism is capable of moving in reciprocating vertical motion in the vertical direction with respect to the base. The reciprocating pendulum motion mechanism is disposed on the reciprocating vertical motion mechanism to be capable of moving in reciprocating pendulum motion in a pendulum direction with respect to the reciprocating vertical motion mechanism. The pendulum motion driving module is kinematically connected to the reciprocating pendulum motion mechanism so that the reciprocating pendulum motion mechanism is capable of moving in reciprocating pendulum motion in the pendulum direction with respect to the reciprocating vertical motion mechanism. Therein an interaction between a reciprocating vertical motion of the reciprocating vertical motion mechanism and a reciprocating pendulum motion of the reciprocating pendulum motion mechanism forms a specific motion path.

Preferably, the base includes a base body and a base column. The base column is supported on the base body. The reciprocating vertical motion mechanism is sleeved on the base column to be capable of sliding in reciprocating vertical motion in the vertical direction with respect to the base column. Further, the base column extends in the vertical direction from the base body.

Preferably, a vertical plane where the vertical direction is located is parallel to a pendulum plane where the pendulum direction is located.

Preferably, the reciprocating pendulum motion mechanism includes a support and two link arms. The support is arranged on the specific motion path. An end of the link arm is pivotally connected to the reciprocating vertical motion mechanism; another end of the link arm is pivotally connected to the support.

Preferably, an interval between the two link arms at a pivot connection with the support is longer than an interval between the two link arms at a pivot connection with the reciprocating vertical motion mechanism.

Preferably, the infant care apparatus further includes a seat, detachably disposed on the support and/or disposed on the support to be capable of rotating in a rotation direction with respect to the support.

Preferably, a rotation plane where the rotation direction is located intersects with a pendulum plane where the pendulum direction is located.

Preferably, the infant care apparatus further includes a seat, disposed on the reciprocating pendulum motion mechanism to be capable of rotating in a rotation direction with respect to the reciprocating pendulum motion mechanism and arranged on the specific motion path. Further, a rotation plane where the rotation direction is located intersects with a pendulum plane where the pendulum direction is located.

Preferably, the infant care apparatus further includes a seat, detachably disposed on the reciprocating pendulum motion mechanism and arranged on the specific motion path.

Preferably, the specific motion path is a vertical motion path, a pendulum motion path, a waved motion path, a figure eight motion path, a circular motion path or a combined motion path of at least two of the above motion paths.

Preferably, the infant care apparatus further includes a programmable processor, electrically connected to the vertical motion driving module and the pendulum motion driving module for controlling the interaction between the reciprocating vertical motion and the reciprocating pendulum motion to form the specific motion path.

Preferably, the infant care apparatus further includes a user control interface, electrically connected to the programmable processor for offering a user to operate the user control interface for setting the specific motion path.

Preferably, the user control interface is connected in wired communication or wireless communication to the programmable processor.

Preferably, the user control interface is disposed on the base.

Preferably, the base includes a base body and a base column. The base column is supported on the base body. The user control interface is disposed on a top portion of the base column.

Compared with the prior art, the infant care apparatus of the invention can cause the reciprocating vertical motion of the reciprocating vertical motion mechanism and the reciprocating pendulum motion of the reciprocating pendulum motion mechanism to coordinate with each other by the vertical motion driving module and the pendulum motion driving module in order to produce a variety of motion paths which are not limited just to bouncing up and down or gliding side to side, so as to be adaptive to various demands of different infants on soothing motions.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
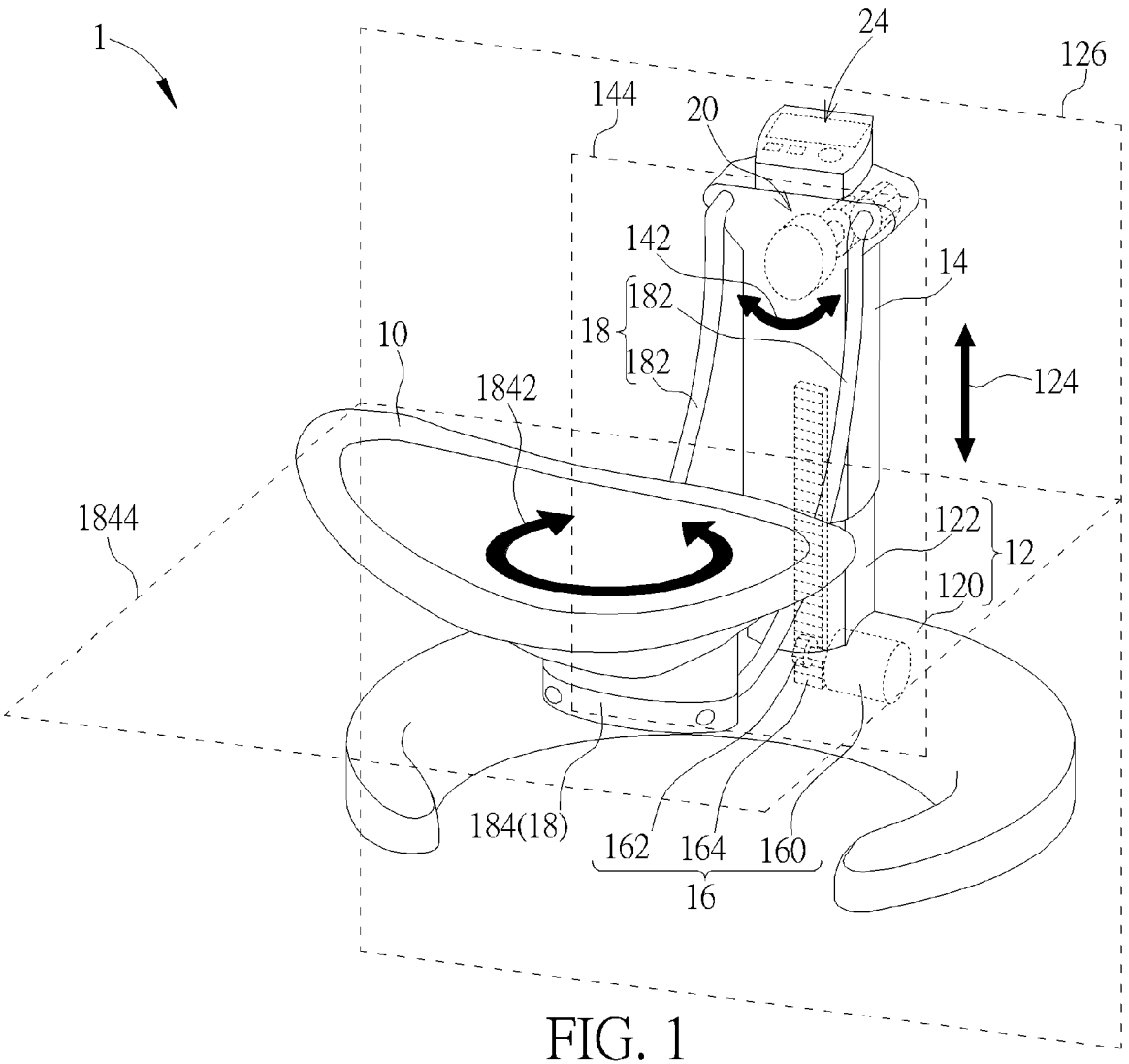
FIG. 1 is a perspective view of an infant care apparatus according to an embodiment of the invention.

Please refer to FIG. 1, which is a perspective view of an infant care apparatus 1 according to an embodiment of the invention. The infant care apparatus 1 includes a seat 10, abase 12, a reciprocating vertical motion mechanism 14, a vertical motion driving module 16, a reciprocating pendulum motion mechanism 18, and a pendulum motion driving module 20. The reciprocating vertical motion mechanism 14 is disposed on the base 12 to be capable of moving in reciprocating vertical motion in a vertical direction 124 with respect to the base 12. The vertical motion driving module 16 is kinematically connected to the reciprocating vertical motion mechanism 14 so that the reciprocating vertical motion mechanism 14 is capable of moving in reciprocating vertical motion in the vertical direction 124 with respect to the base 12. The reciprocating pendulum motion mechanism 18 is disposed on the reciprocating vertical motion mechanism 14 to be capable of moving in reciprocating pendulum motion in a pendulum direction 142 with respect to the reciprocating vertical motion mechanism 14. The pendulum motion driving module 20 is kinematically connected to the reciprocating pendulum motion mechanism 18 so that the reciprocating pendulum motion mechanism 18 is capable of moving in reciprocating pendulum motion in the pendulum direction 142 with respect to the reciprocating vertical motion mechanism 14. An interaction between a reciprocating vertical motion of the reciprocating vertical motion mechanism 14 and a reciprocating pendulum motion of the reciprocating pendulum motion mechanism 18 forms a specific motion path (which will be described further in the following). The seat 10 is disposed on the reciprocating pendulum motion mechanism 18 and arranged on the specific motion path. By the coordinated motions of the reciprocating vertical motion mechanism 14 and the reciprocating pendulum motion mechanism 18, the seat 10 can offer a variety of motion paths which are not limited just to bouncing up and down or gliding side to side, so as to be further adaptive to various demands of different infants on soothing motions.

Further, in the embodiment, the base 12 includes a base body 120 and a base column 122 supported on the base body 120. The base column 122 extends in the vertical direction 124 from the base body 120, so as to firmly structurally support and guide the reciprocating vertical motion mechanism 14. The reciprocating vertical motion mechanism 14 is sleeved on the base column 122 to be capable of sliding in reciprocating vertical motion in the vertical direction 124 with respect to the base column 122. In practice, the base column 122 thereon can dispose ball, roller, and/or self lubricated bearings to ensure that the reciprocating vertical motion mechanism 14 moves smoothly and quietly. The vertical motion driving module 16 is disposed in the base 12 and includes a motor 160, a drive gear 162 driven by the motor 160, and a rack 164 meshing with the drive gear 162. The rack 164 is fixedly connected to the reciprocating vertical motion mechanism 14. By controlling the rotation speed and rotation direction of the motor 160, the reciprocating vertical motion of the reciprocating vertical motion mechanism 14 with respect to the base column 122 can be controlled. In practice, the vertical motion driving module 16 can be realized by other ways such as screw and mating carriage, a scissors mechanism, cable and pulley, crank and connecting rod, etc.

In the embodiment, the reciprocating pendulum motion mechanism 18 includes two link arms 182 and a support 184. The support 184 is arranged on the specific motion path. An end of the link arm 182 is pivotally connected to the reciprocating vertical motion mechanism 14; the other end of the link arm 182 is pivotally connected to the support 184. The seat 10 is disposed on the support 184. The pendulum motion of the reciprocating pendulum motion mechanism 18 can be achieved by connecting the pendulum motion driving module 20 with the reciprocating pendulum motion mechanism 18. In practice, the pendulum motion driving module 20 directly drives the link arms 182 by a motor, so that the link arms 182 can swing with respect to the reciprocating vertical motion mechanism 14; however, the invention is not limited thereto. For example, the link arms 182 can be driven by a crank connected to a gear driven by a motor, or the link arms 182 can just freely swing due to gravity. It is added that in the embodiment, the seat 10 is detachably disposed on the support 184 of the reciprocating pendulum motion mechanism 18, but the invention is not limited thereto. If there is no need to detach the seat 10 from the reciprocating pendulum motion mechanism 18, the support 184 can be skipped and the link arms 182 are pivotally connected to the bottom portion of the seat 10 directly.

Figure 2:
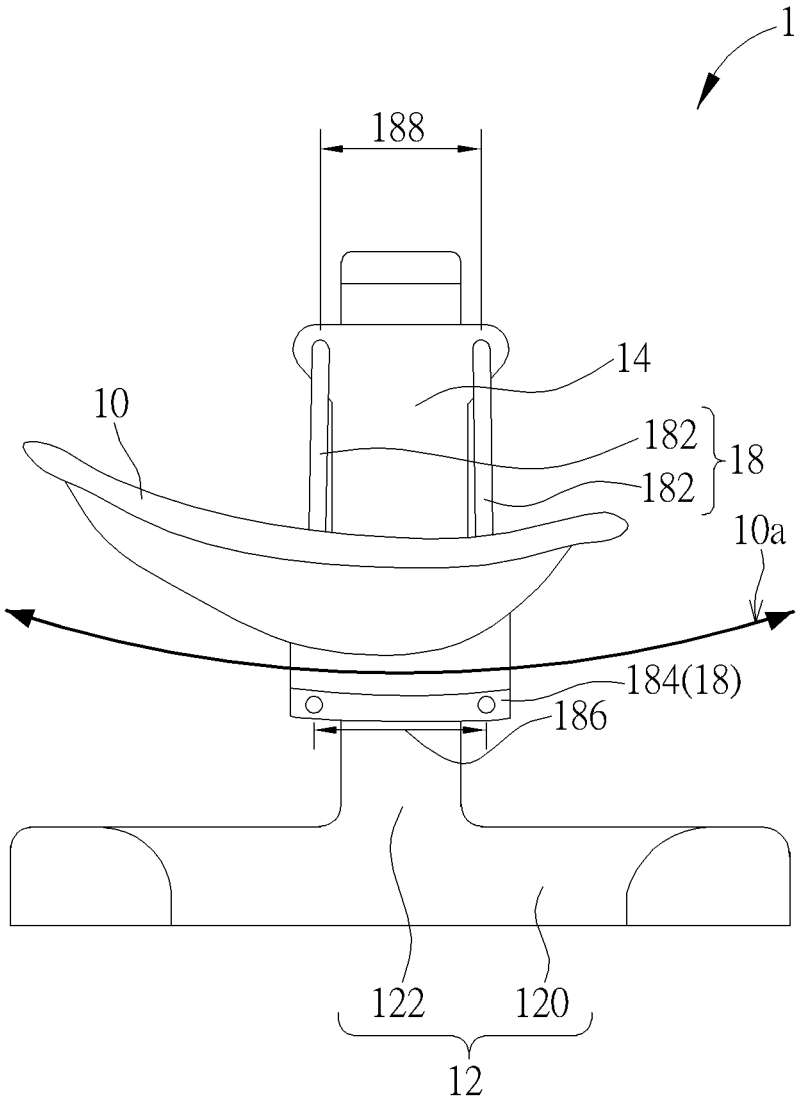
FIGS. 2 through 4 are successive action diagrams of a reciprocating pendulum motion mechanism of the infant care apparatus in FIG. 1.
Figure 3:
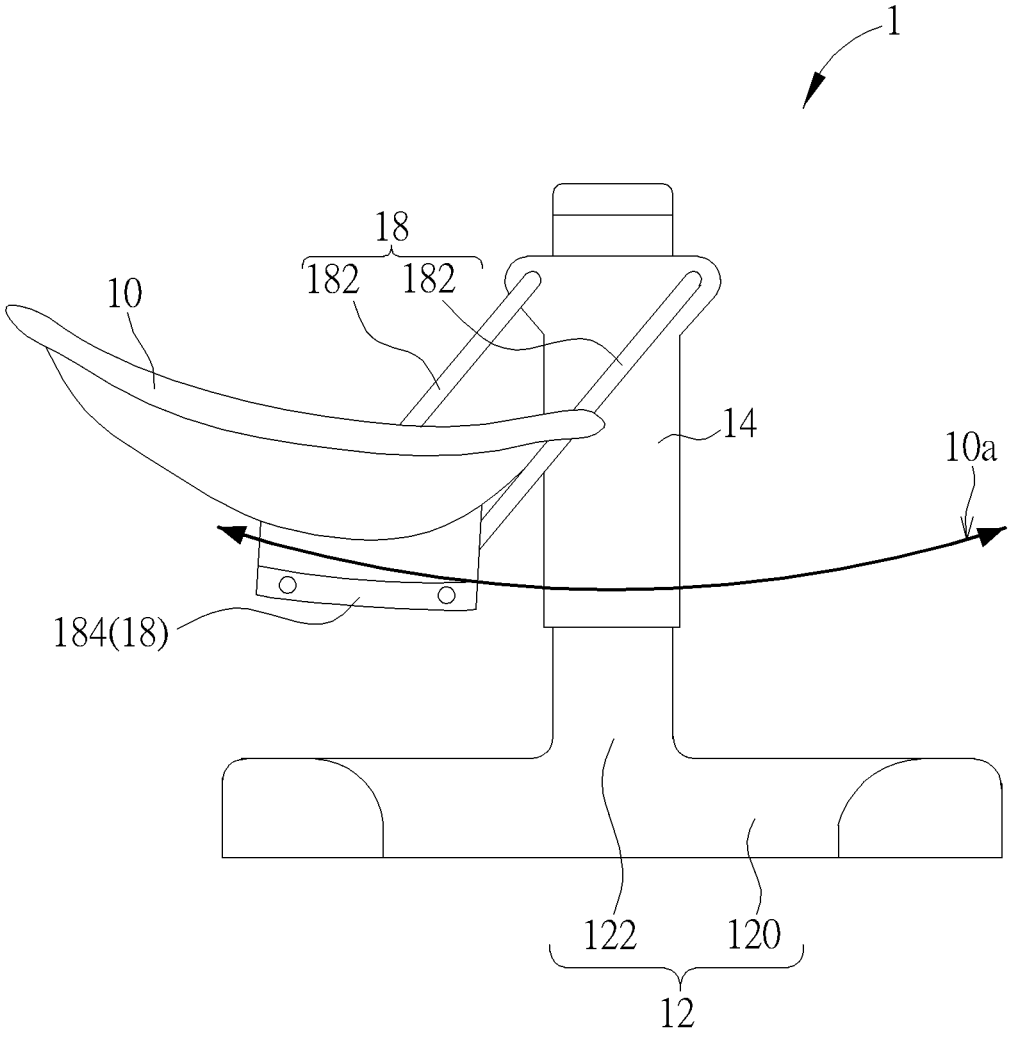
Figure 4:
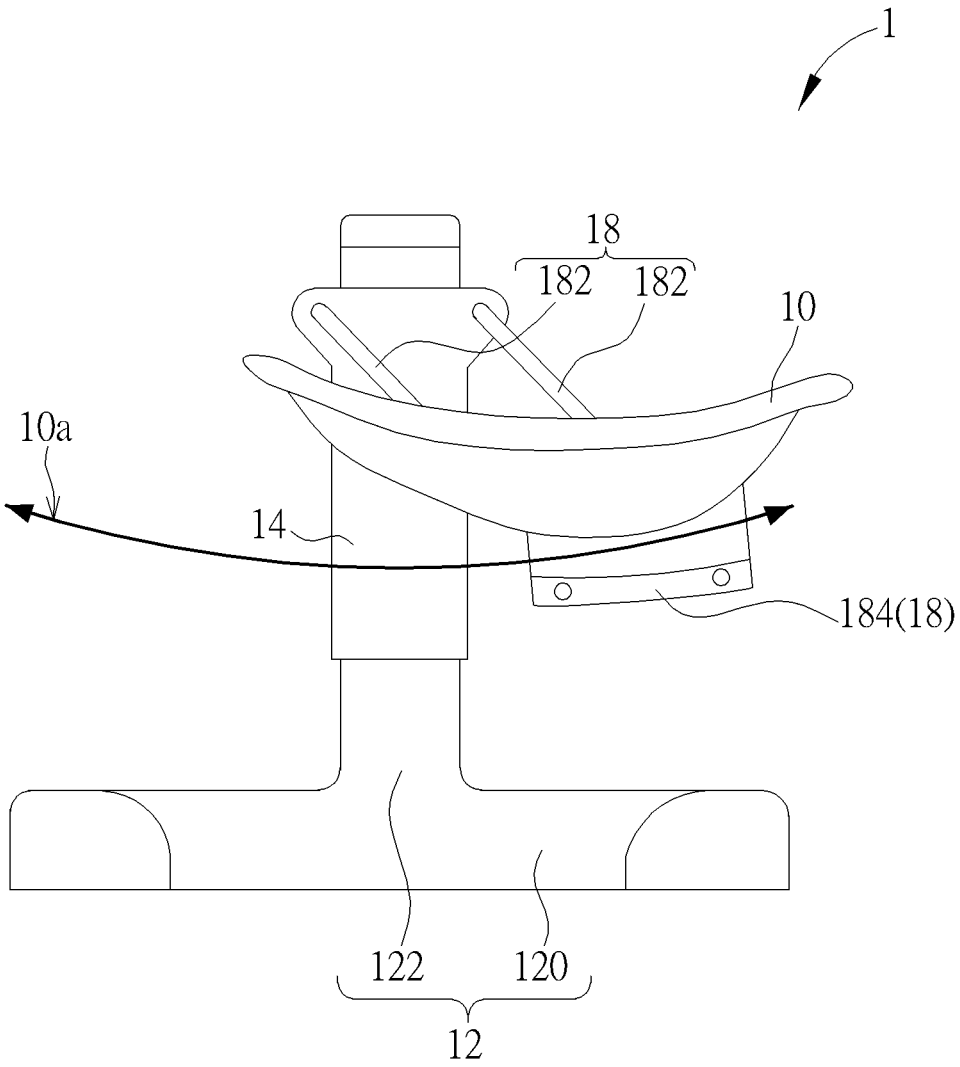

Please refer to FIGS. 2 through 4, which are successive action diagrams of the reciprocating pendulum motion mechanism 18; therein, a motion path 10*a* of the seat 10 is illustrated by a solid line with arrows in the figures. In the embodiment, the link arms 182, the support 184, and the reciprocating vertical motion mechanism 14 form a four-bar linkage. Because an interval 186 between the two link arms 182 at a pivot connection with the support 184 (or the seat 10) is longer than an interval 188 between the two link arms 182 at a pivot connection with the reciprocating vertical motion mechanism 14 (as shown in FIG. 2), the disposition angle of the seat 10 varies as the reciprocating pendulum motion mechanism 18 swings. When the seat 10 swings to the left side, the seat 10 slightly tilts toward the right; when the seat 10 swings to the right side, the seat 10 slightly tilts toward the left. This further approaches actual situations of parents holding their baby, which enhances the effect of soothing babies. The above tilt extent can be controlled by setting the difference between the intervals 186 and 188. In a practical application, if the seat 10 needs to be kept in the same disposition angle during the whole swinging, the intervals 186 and 188 can be set to be the same; that is, the link arms 182 are parallel disposed.

Figure 5:
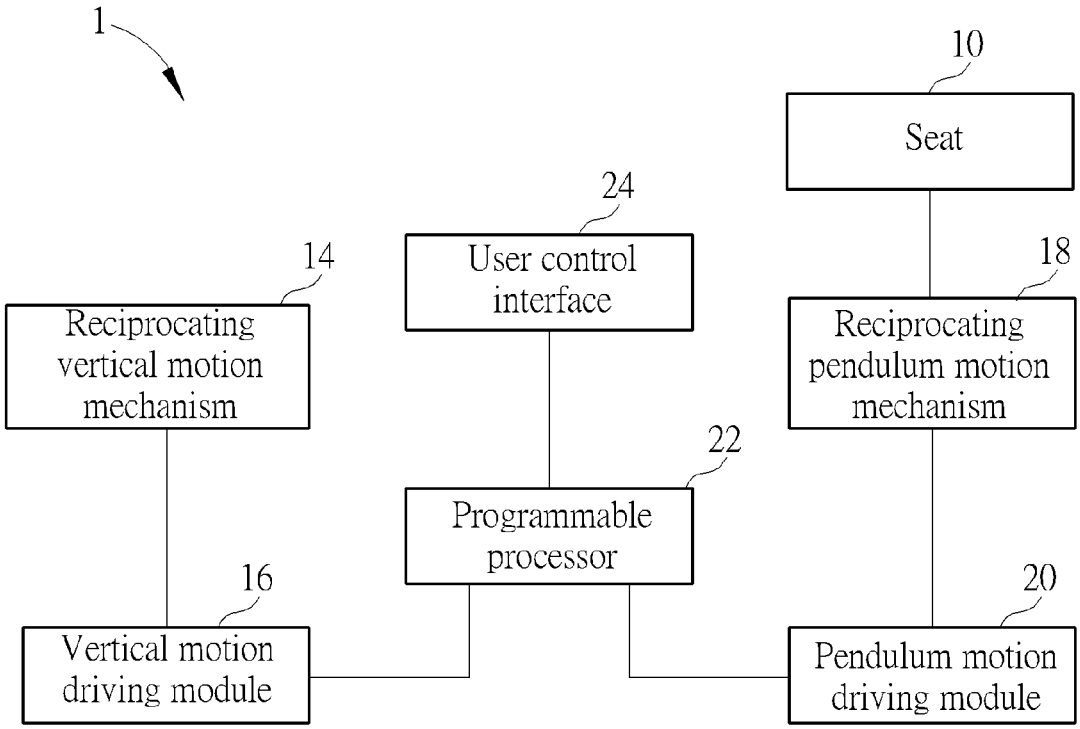
FIG. 5 is a functional block diagram of the infant care apparatus in FIG. 1.
Figure 6:
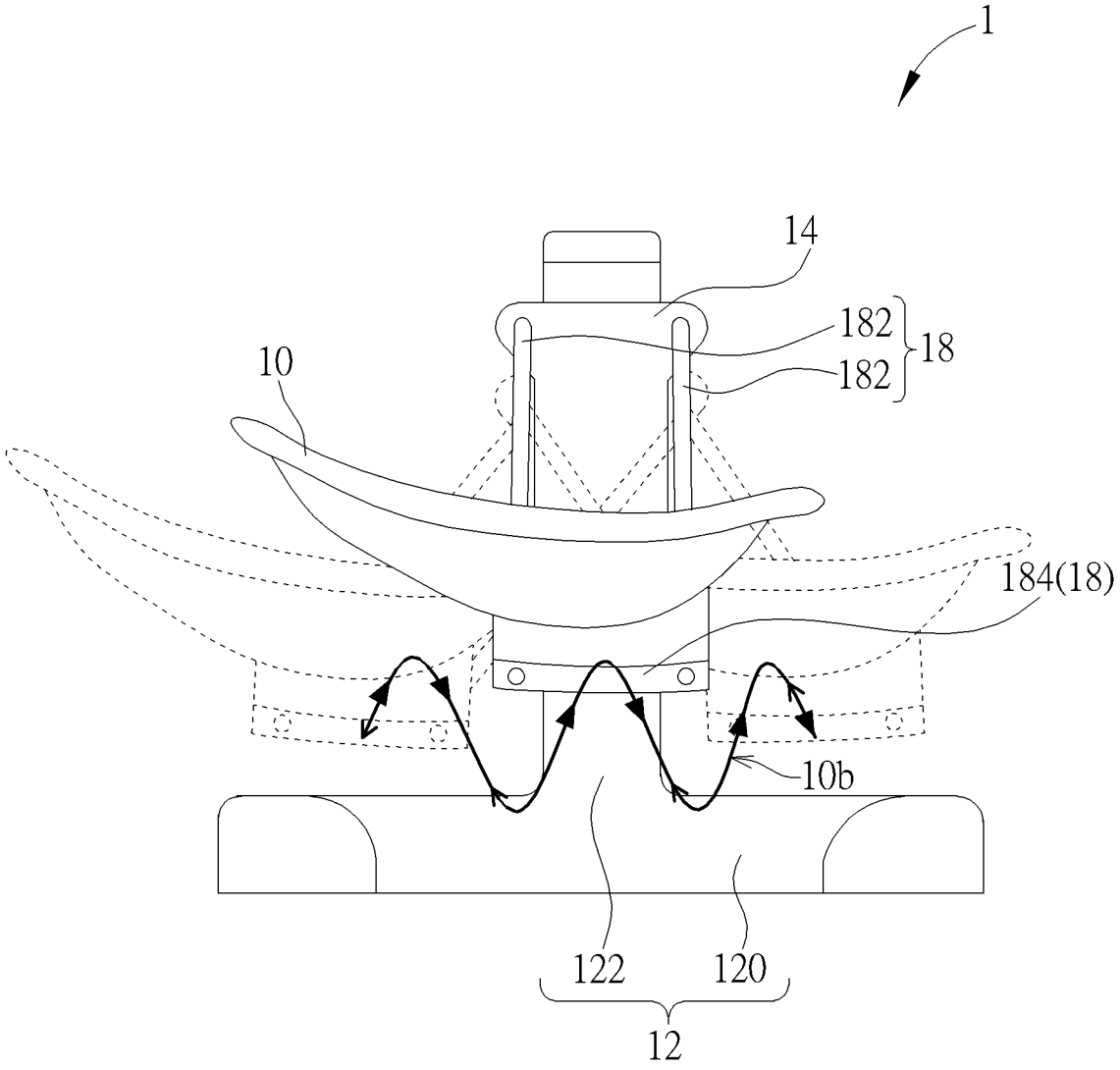
FIG. 6 is a schematic diagram illustrating a seat of the infant care apparatus in FIG. 1 moving along a waved motion path.
Figure 7:
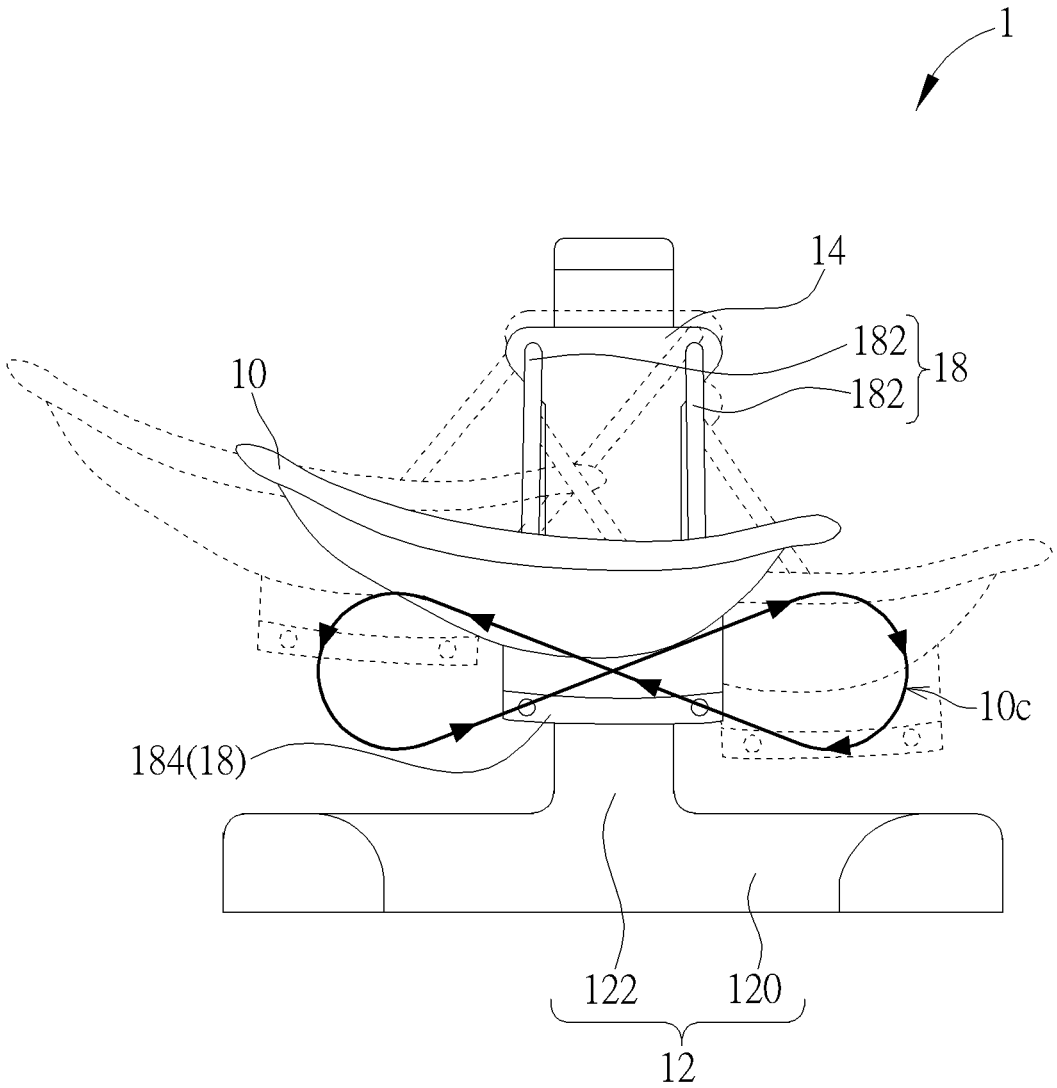
FIG. 7 is a schematic diagram illustrating the seat of the infant care apparatus in FIG. 1 moving along a figure eight motion path.
Figure 8:
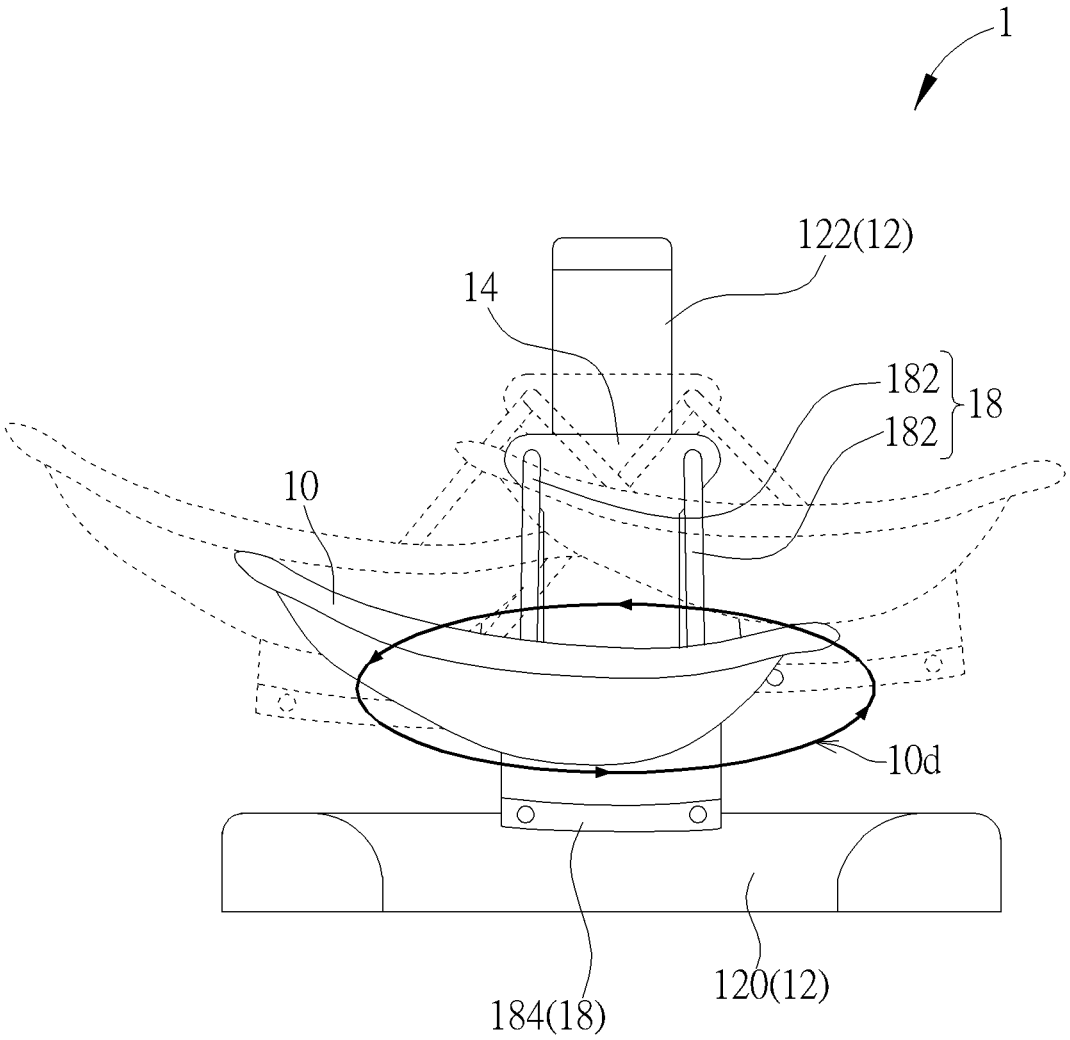
FIG. 8 is a schematic diagram illustrating the seat of the infant care apparatus in FIG. 1 moving along a circular motion path.

The above motion path 10*a* is simply a pendulum motion path, also an example for the specific motion path. In practice, many kinds of the action coordination of the reciprocating pendulum motion mechanism 18 with the reciprocating vertical motion mechanism 14 can be pre-stored in a controller, or the reciprocating vertical motion of the reciprocating pendulum motion mechanism 18 and the reciprocating pendulum motion of the reciprocating vertical motion mechanism 14 are controlled simultaneously so that the seat 10 can move along different specific motion paths. Please refer to FIG. 5, which is a functional block diagram of the infant care apparatus 1. The infant care apparatus 1 also includes a programmable processor 22 and a user control interface 24. The programmable processor 22 is electrically connected to the vertical motion driving module 16, the pendulum motion driving module 20, and the user control interface 24 respectively. The user control interface 24 can be disposed on the top portion of the base column 122 (shown by dashed lines in FIG. 1) or on somewhere else of the base 12. The user control interface 24 also can includes a displaying screen and a plurality of physical or virtual buttons for turning on or off, selecting motion paths, speeds, directions and so on. A user can perform setting by the user control interface 24. The programmable processor 22 controls the interaction between the reciprocating vertical motion of the reciprocating vertical motion mechanism 14 and the reciprocating pendulum motion of the reciprocating pendulum motion mechanism 18 according to the above setting, so as to form one specific motion path along which the seat 10 moves. In other words, the user operates the user control interface 24 to set the specific motion path. In practice, the user control interface 24 can be communication connected to the programmable processor 22 in a wired communication method or a wireless communication method, for improving the convenience in use. For the use convenience of users, several specific motion paths can be provided in advance, such as a waved motion path 10*b* (as shown in FIG. 6), a figure eight motion path 10*c* (as shown in FIG. 7), a circular motion path 10*d* (as shown FIG. 8), or a combined motion path of at least two of the above motion paths. The speeds and directions therefor can also be provided in advance or set in addition. In practice, the user also can modify the provided specific motion paths to form a customized motion path, which facilitates the satisfaction of the various demands of different infants.

It is added that, as shown in FIG. 1, in the embodiment, a vertical plane 126 where the vertical direction 124 is located is parallel to a pendulum plane 144 where the pendulum direction 142 is located. Therefore, the reciprocating pendulum motion of the reciprocating pendulum motion mechanism 18 with respect to the reciprocating vertical motion mechanism 14 occurs in principle on a plane parallel to the vertical direction 124 (i.e. a plane parallel to the gravity direction or the pendulum plane 144) based on a view of the motion path of the support 184, so the reciprocating pendulum motion shows in itself a movement of a pendulum. During the pendulum movement, the position of the support 184 varies in the gravity direction, which is different to a reciprocating swing occurring by a cantilever only horizontally rotating (i.e. rotating perpendicular to the gravity direction). In addition, besides the different planes where the reciprocating movements occur, one of other differences thereof is that the cantilever needs to be powered through the whole horizontal reciprocating movement. On the contrary, the pendulum motion of the reciprocating pendulum motion mechanism 18 of the invention can use the gravity to save the power for driving the reciprocating pendulum motion mechanism 18 by the pendulum motion driving module 20 in a certain extent.

Figure 9:
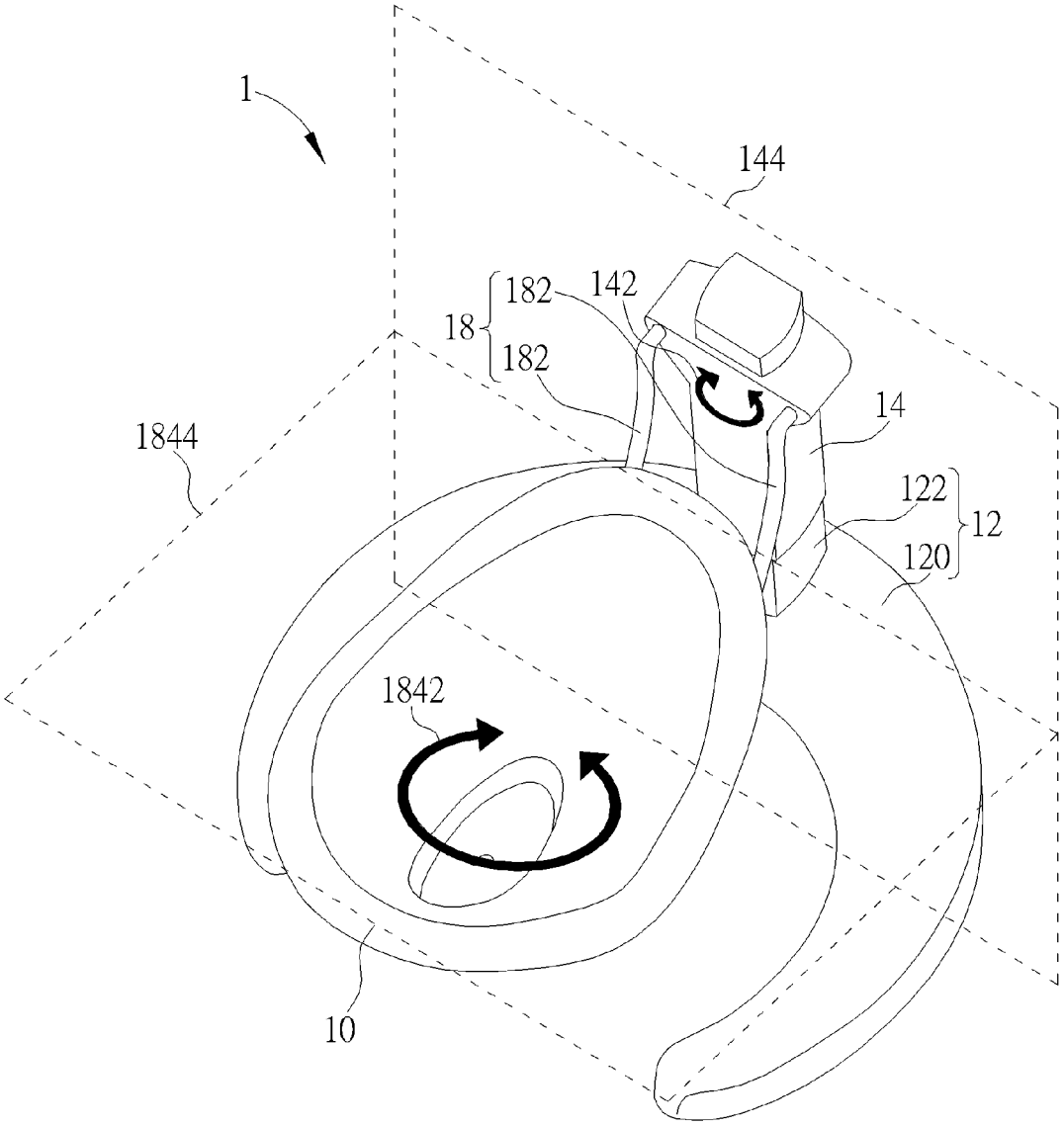
FIG. 9 is a perspective view of the seat of the infant care apparatus in FIG. 1 connected to the reciprocating pendulum motion mechanism in another angle.

Please refer to FIG. 1 and FIG. 9 which is a perspective view of the seat 10 connected to the reciprocating pendulum motion mechanism 18 in another angle. In the embodiment, the seat 10 is disposed on the support 184 to be capable of rotating in a rotation direction 1842 with respect to the support 184. Therefore, the seat 10 can be connected to the support 184 in different angles. Therein, a rotation plane 1844 where the rotation direction 1842 is located intersects with the pendulum plane 144 where the pendulum direction 142 is located. As shown by FIG. 1, the body of an infant lying on the seat 10 is parallel to the motion path; as shown by FIG. 9, the body of the infant lying on the seat 10 is perpendicular to the motion path. In a practical application, the seat 10 can be connected to the reciprocating pendulum motion mechanism 18 in other angles, so that the body of the infant lying on the seat 10 and the motion path form a non-zero included angle. Such design can diversify the rocking effect even under the same motion path, which also facilitates the satisfaction of the various demands of different infants.

Figure 10:
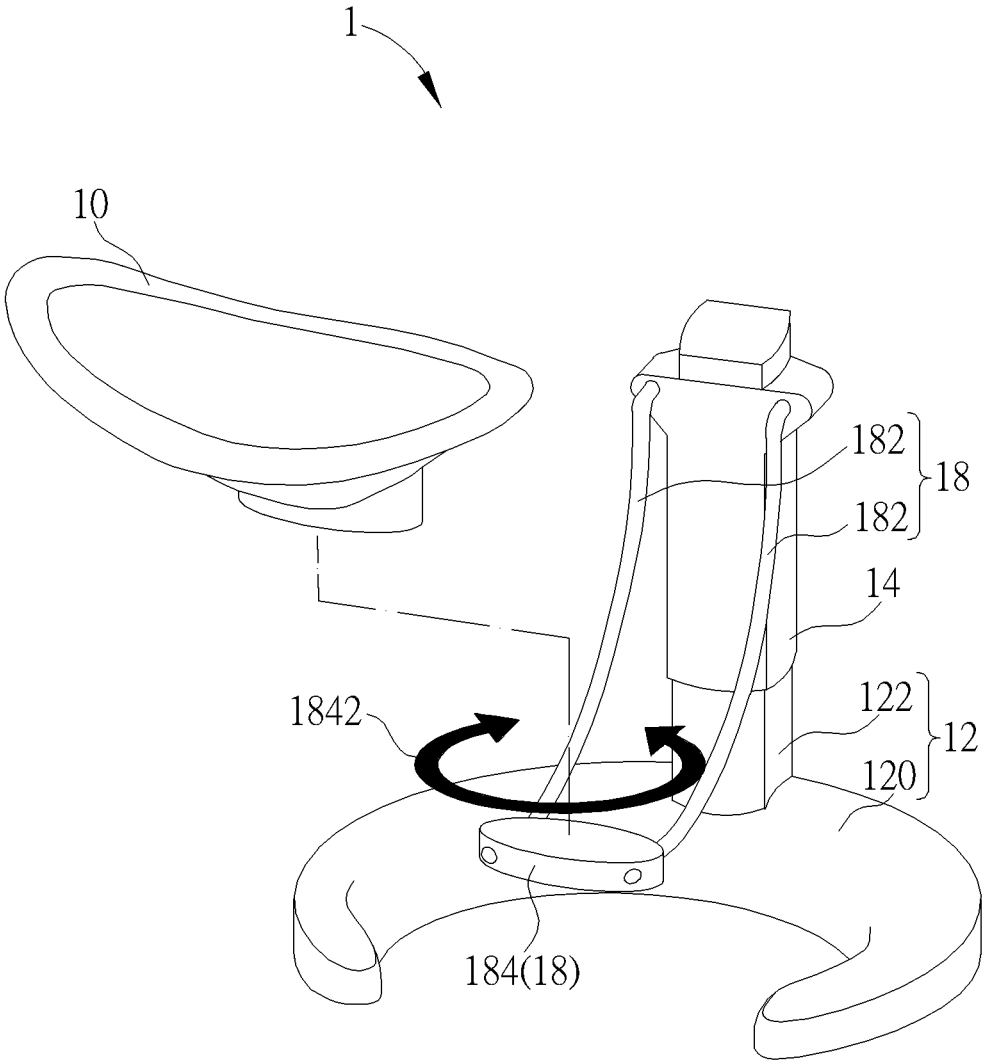
FIG. 10 is a perspective view of the seat of the infant care apparatus in FIG. 1 detached from the support.

Please refer to FIG. 10, which is a perspective view of the seat 10 detached from the support 184. In the embodiment, the seat 10 is detachably disposed on the support 184 of the reciprocating pendulum motion mechanism 18. Such detachable engagement design is conducive to reduction of the probability of awaking infants by parents when moving the infants. In practice, the seat 10 can be engaged to the support 184 by a snap structure, or just placed on the support 184 by a recess structure formed on the support 184. Even other detachable engagement structures can be used to connecting the seat 10 and the support 184. These are known by skilled persons based on the above description to be completed easily and will not be described more in detail.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant care apparatus, comprising:

a base;

a reciprocating vertical motion mechanism, disposed on the base to be capable of moving in reciprocating vertical motion in a vertical direction with respect to the base;

a vertical motion driving module, kinematically connected to the reciprocating vertical motion mechanism so that the reciprocating vertical motion mechanism is capable of moving in reciprocating vertical motion in the vertical direction with respect to the base;

a reciprocating pendulum motion mechanism, disposed on the reciprocating vertical motion mechanism to be capable of moving in reciprocating pendulum motion in a pendulum direction with respect to the reciprocating vertical motion mechanism; and a pendulum motion driving module, kinematically connected to the reciprocating pendulum motion mechanism so that the reciprocating pendulum motion mechanism is capable of moving in reciprocating pendulum motion in the pendulum direction with respect to the reciprocating vertical motion mechanism;

wherein an interaction between a reciprocating vertical motion of the reciprocating vertical motion mechanism and a reciprocating pendulum motion of the reciprocating pendulum motion mechanism forms a specific motion path.

2. The infant care apparatus of claim 1, wherein the base includes:

a base body; and a base column, supported on the base body;

wherein the reciprocating vertical motion mechanism is sleeved on the base column to be capable of sliding in reciprocating vertical motion in the vertical direction with respect to the base column.

3. The infant care apparatus of claim 2, wherein the base column extends in the vertical direction from the base body.

4. The infant care apparatus of claim 1, wherein a vertical plane where the vertical direction is located is parallel to a pendulum plane where the pendulum direction is located.

5. The infant care apparatus of claim 1, wherein the reciprocating pendulum motion mechanism includes:

a support, arranged on the specific motion path; and two link arms, an end of the link arm being pivotally connected to the reciprocating vertical motion mechanism, another end of the link arm being pivotally connected to the support.

6. The infant care apparatus of claim 5, wherein an interval between the two link arms at a pivot connection with the support is longer than an interval between the two link arms at a pivot connection with the reciprocating vertical motion mechanism.

7. The infant care apparatus of claim 5, further comprising:

a seat, disposed on the support to be capable of rotating in a rotation direction with respect to the support.

8. The infant care apparatus of claim 7, wherein a rotation plane where the rotation direction is located intersects with a pendulum plane where the pendulum direction is located.

9. The infant care apparatus of claim 5, further comprising:

a seat, detachably disposed on the support.

10. The infant care apparatus of claim 1, further comprising:

a seat, disposed on the reciprocating pendulum motion mechanism to be capable of rotating in a rotation direction with respect to the reciprocating pendulum motion mechanism and arranged on the specific motion path.

11. The infant care apparatus of claim 10, wherein a rotation plane where the rotation direction is located intersects with a pendulum plane where the pendulum direction is located.

12. The infant care apparatus of claim 1, further comprising:

a seat, detachably disposed on the reciprocating pendulum motion mechanism and arranged on the specific motion path.

13. The infant care apparatus of claim 1, wherein the specific motion path is a vertical motion path, a pendulum motion path, a waved motion path, a figure eight motion path, a circular motion path or a combined motion path of at least two of the above motion paths.

14. The infant care apparatus of claim 1, further comprising:

a programmable processor, electrically connected to the vertical motion driving module and the pendulum motion driving module for controlling the interaction between the reciprocating vertical motion and the reciprocating pendulum motion to form the specific motion path.

15. The infant care apparatus of claim 14, further comprising:

a user control interface, electrically connected to the programmable processor for offering a user to operate the user control interface for setting the specific motion path.

16. The infant care apparatus of claim 15, wherein the user control interface is connected in wired communication or wireless communication to the programmable processor.

17. The infant care apparatus of claim 15, wherein the user control interface is disposed on the base.

18. The infant care apparatus of claim 17, wherein the base includes:

a base body; and a base column, supported on the base body;

wherein the user control interface is disposed on a top portion of the base column.

* * * * *